US010874006B1

(12) United States Patent
Davis et al.

(10) Patent No.: US 10,874,006 B1
(45) Date of Patent: Dec. 22, 2020

(54) LIGHTING FIXTURE CONTROLLER FOR CONTROLLING COLOR TEMPERATURE AND INTENSITY

(71) Applicant: ABL IP Holding LLC, Atlanta, GA (US)

(72) Inventors: Yelena N. Davis, Worthington, OH (US); Yaser Abdelsamed, Granville, OH (US); Ryan D. Meldahl, Newark, OH (US); Yan Rodriguez, Alpharetta, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/811,076

(22) Filed: Mar. 6, 2020

Related U.S. Application Data

(60) Provisional application No. 62/815,783, filed on Mar. 8, 2019.

(51) Int. Cl.
*H05B 45/20* (2020.01)
*H05B 45/10* (2020.01)
(Continued)

(52) U.S. Cl.
CPC ..... *H05B 45/20* (2020.01); *H05B 45/10* (2020.01); *H05B 45/325* (2020.01); *H05B 45/60* (2020.01); *H05B 47/19* (2020.01)

(58) Field of Classification Search
CPC ..... H05B 45/00; H05B 47/155; H05B 45/20; H05B 47/10; H05B 39/085; H05B 45/24; H05B 47/175; H05B 47/00; H05B 33/145
(Continued)

(56) References Cited

U.S. PATENT DOCUMENTS 3,902,056 A 8/1975 Aizenberg et al.
4,246,477 A 1/1981 Latter
(Continued)

FOREIGN PATENT DOCUMENTS

CA 2767985 1/2011
CA 2964005 10/2017
(Continued)

OTHER PUBLICATIONS

2×4 LED Flat Panel, Cybertech, Main Place Lighting, Available Online at: https://shopmainplacelighting.com/collections/commercial-lighting/products/2-x-4-led-flat-panel-1, Accessed from Internet on May 14, 2019, 3 pages.
(Continued)

*Primary Examiner* — Wei (Victor) Y Chan
(74) *Attorney, Agent, or Firm* — Kilpatrick Townsend & Stockton LLP

(57) ABSTRACT

A light fixture controller is configured for controlling the color temperature and intensity of a light fixture that includes at least two LED groups. Each LED group includes multiple LEDs configured to produce light at certain color temperatures. The light fixture controller receives a color temperature setting and an intensity setting for the light fixture and generates control signals based on these settings. A first control signal only turns on the first LED group for a first duration of a cycle and a second control signal only turns on the second LED group for a second duration of the cycle. The ratio between the first and second duration is determined based on the color temperature setting. The control signal further includes a dimming control signal for controlling a current flowing through the LED groups based on the intensity setting for the light fixture.

20 Claims, 6 Drawing Sheets

(51) Int. Cl.
*H05B 47/19* (2020.01)
*H05B 45/00* (2020.01)
*H05B 45/325* (2020.01)

(58) Field of Classification Search
USPC ..... 315/293, 259, 291, 312, 294, 295, 297
See application file for complete search history.

(56) References Cited

U.S. PATENT DOCUMENTS 4,351,588 A 9/1982 Zullig
4,539,625 A 9/1985 Bornstein et al.
4,576,440 A 3/1986 Worthington
4,922,930 A 5/1990 Adkins et al.
5,099,622 A 3/1992 Sutton
5,143,065 A 9/1992 Adkins et al.
5,528,471 A 6/1996 Green
5,581,447 A 12/1996 Raasakka
5,716,442 A 2/1998 Fertig
5,896,712 A 4/1999 Chao
5,896,713 A 4/1999 Chao et al.
6,035,593 A 3/2000 Chao et al.
6,142,645 A 11/2000 Han
6,149,283 A 11/2000 Conway et al.
6,168,299 B1 1/2001 Yan
6,201,351 B1 3/2001 Rudolph et al.
6,219,977 B1 4/2001 Chao et al.
6,234,648 B1 5/2001 Borner et al.
6,323,598 B1 11/2001 Guthrie et al.
6,363,667 B2 4/2002 O'Neill
6,363,668 B2 4/2002 Rillie et al.
6,381,070 B1 4/2002 Cheng
6,441,558 B1 8/2002 Muthu et al.
6,528,782 B1 3/2003 Zhang et al.
6,967,448 B2 11/2005 Morgan et al.
6,972,755 B2 12/2005 Plangger
6,985,163 B2 1/2006 Riddle et al.
6,995,355 B2 2/2006 Rains, Jr. et al.
7,014,336 B1 3/2006 Ducharme et al.
7,015,825 B2 3/2006 Callahan
7,057,821 B2 6/2006 Zincone
7,088,059 B2 8/2006 McKinney et al.
7,119,500 B2 10/2006 Young
7,119,501 B2 10/2006 Young
7,135,664 B2 11/2006 Vornsand et al.
7,146,768 B2 12/2006 Rillie
7,173,383 B2 2/2007 Vornsand et al.
7,178,941 B2 2/2007 Roberge et al.
7,202,607 B2 4/2007 Kazar et al.
7,234,279 B2 6/2007 Sincic et al.
7,288,902 B1 10/2007 Melanson
7,307,614 B2 12/2007 Vinn
7,317,288 B2 1/2008 Lin et al.
7,322,156 B1 1/2008 Rillie et al.
7,329,998 B2 2/2008 Jungwirth
7,334,917 B2 2/2008 Laski
7,358,929 B2 4/2008 Mueller et al.
7,408,887 B2 8/2008 Sengupta et al.
7,416,312 B1 8/2008 McDermott
7,423,387 B2 9/2008 Robinson et al.
7,497,590 B2 3/2009 Rains, Jr. et al.
7,498,753 B2 3/2009 McAvoy et al.
7,520,634 B2 4/2009 Ducharme et al.
7,546,709 B2 6/2009 Jaster et al.
7,621,081 B2 11/2009 Rillie
7,638,743 B2 12/2009 Bartol et al.
7,639,423 B2 12/2009 Kinney et al.
7,649,322 B2 1/2010 Neuman et al.
7,667,408 B2 2/2010 Melanson et al.
7,706,884 B2 4/2010 Libbus
7,736,014 B2 6/2010 Blomberg
7,764,028 B2 7/2010 Mariyama et al.
7,781,713 B2 8/2010 Papamichael et al.
7,875,252 B2 1/2011 Ma et al.
7,883,239 B2 2/2011 Rains, Jr. et al.
7,902,560 B2 3/2011 Bierhuizen et al.
7,902,761 B2 3/2011 Ang et al.
7,956,552 B2 6/2011 Champion et al.
7,959,332 B2 6/2011 Tickner et al.
7,976,189 B2 7/2011 Osborn
7,982,409 B2 7/2011 Hasnain et al.
7,995,277 B2 8/2011 Patterson
8,008,850 B2 8/2011 Su et al.
8,008,866 B2 8/2011 Newman, Jr. et al.
8,018,172 B2 9/2011 Leshniak
8,018,653 B2 9/2011 Jaster
8,022,634 B2 9/2011 Greenfeld
8,068,282 B1 11/2011 Kastner et al.
8,082,705 B2 12/2011 Jaster et al.
8,083,363 B2 12/2011 Jaster
8,096,686 B2 1/2012 Wilcox
8,098,433 B2 1/2012 Rillie et al.
8,104,921 B2 1/2012 Hente et al.
8,111,460 B1 2/2012 Huang
8,115,419 B2 2/2012 Given et al.
8,118,441 B2 2/2012 Hessling
8,132,375 B2 3/2012 Jaster
8,139,908 B2 3/2012 Moyer
8,164,276 B2 4/2012 Kuwabara
8,172,415 B2 5/2012 Wegh et al.
8,203,260 B2 6/2012 Li et al.
8,227,996 B2 7/2012 Leshniak
8,228,002 B2 7/2012 Newman, Jr. et al.
8,232,733 B2 7/2012 Newman, Jr. et al.
8,278,832 B2 10/2012 Hung et al.
8,313,224 B2 11/2012 Moyer
8,317,362 B2 11/2012 Ku et al.
8,319,452 B1 11/2012 Hamel et al.
8,324,815 B2 12/2012 Maxik et al.
8,324,823 B2 12/2012 Choi et al.
8,324,840 B2 12/2012 Shteynberg et al.
8,330,378 B2 12/2012 Maehara et al.
8,334,658 B2 12/2012 Balakrishnan
8,339,048 B2 12/2012 Newman, Jr. et al.
8,354,803 B2 1/2013 Newman, Jr. et al.
8,358,089 B2 1/2013 Hsia et al.
8,371,078 B2 2/2013 Jaster
8,373,362 B2 2/2013 Chemel et al.
8,373,364 B2 2/2013 Santo et al.
8,427,063 B2 4/2013 Hulett
8,436,549 B2 5/2013 Hasnain
8,441,202 B2 5/2013 Wilson et al.
8,441,205 B2 5/2013 Hsieh et al.
8,441,213 B2 5/2013 Huynh
8,455,807 B2 6/2013 Sun et al.
8,456,109 B1 6/2013 Wray
8,459,851 B2 6/2013 Wemmer
8,466,628 B2 6/2013 Shearer et al.
8,471,481 B2 6/2013 Shin et al.
8,476,829 B2 7/2013 Maxik et al.
8,476,837 B2 7/2013 Vos
8,491,159 B2 7/2013 Recker et al.
8,519,642 B2 8/2013 Ahn et al.
8,525,416 B2 9/2013 Roger et al.
8,536,794 B2 9/2013 Melanson et al.
8,558,782 B2 10/2013 You et al.
8,568,011 B2 10/2013 Rillie et al.
8,569,977 B2 10/2013 Lanham et al.
8,581,520 B1 11/2013 Wray
8,587,212 B2 11/2013 Li et al.
8,598,804 B2 12/2013 Foxall et al.
8,598,809 B2 12/2013 Negley et al.
8,601,757 B2 12/2013 Jaster et al.
8,618,744 B2 12/2013 Briggs
8,622,560 B2 1/2014 Di Trapani et al.
8,629,629 B2 1/2014 Hariharan
8,633,650 B2 1/2014 Sauerlaender
8,638,044 B2 1/2014 Briggs
8,638,045 B2 1/2014 Kunst et al.
8,643,304 B2 2/2014 Hamel et al.
8,643,308 B2 2/2014 Grajcar
8,653,741 B2 2/2014 Monney
8,653,752 B2 2/2014 Sakuragi et al.
8,659,514 B2 2/2014 Sato et al.
8,669,722 B2 3/2014 Yeh et al.

(56) References Cited

U.S. PATENT DOCUMENTS 8,686,651 B2 4/2014 Lynch et al.
8,698,416 B2 4/2014 Pan
8,702,271 B2 4/2014 Rains, Jr. et al.
8,704,460 B2 4/2014 Hariharan
8,710,754 B2 4/2014 Baddela et al.
8,716,946 B2 5/2014 Lee et al.
8,736,183 B2 5/2014 Chao
8,742,695 B2 6/2014 Wray
8,746,942 B2 6/2014 Bracale
8,760,262 B2 6/2014 Veskovic
8,766,555 B2 7/2014 Tu et al.
8,773,337 B2 7/2014 Li et al.
8,779,675 B2 7/2014 Mikani et al.
8,779,681 B2 7/2014 Adler
8,783,887 B2 7/2014 Caruso et al.
8,783,901 B2 7/2014 Zoorob et al.
8,791,642 B2 7/2014 van de Ven et al.
8,810,140 B2 8/2014 Huynh
8,823,289 B2 9/2014 Linz et al.
8,829,822 B2 9/2014 Laski et al.
8,837,048 B2 9/2014 Jaster
8,841,851 B2 9/2014 Cho et al.
8,841,864 B2 9/2014 Maxik et al.
8,847,477 B2 9/2014 Kawashima et al.
8,847,504 B2 9/2014 Setomoto et al.
8,872,438 B2 10/2014 Zhou et al.
8,878,443 B2 11/2014 Luo et al.
8,890,419 B2 11/2014 Stack
8,890,421 B2 11/2014 Kraft
8,890,436 B2 11/2014 Chou
8,896,924 B2 11/2014 Weaver
8,901,835 B2 12/2014 Kang et al.
8,912,734 B2 12/2014 Melanson et al.
8,914,312 B2 12/2014 McLaughlin et al.
8,922,126 B2 12/2014 Bora et al.
8,928,249 B2 1/2015 Raj et al.
8,937,434 B2 1/2015 Datta
8,941,312 B2 1/2015 McRae
8,955,269 B2 2/2015 Rillie
8,958,157 B2 2/2015 Rillie et al.
8,975,823 B2 3/2015 Yang et al.
8,982,467 B2 3/2015 Jaster
9,000,678 B2 4/2015 Huynh
9,000,680 B2 4/2015 Melanson et al.
9,018,856 B2 4/2015 Jeong
9,027,292 B2 5/2015 O'Neill et al.
9,052,452 B2 6/2015 Maxey
9,055,647 B2 6/2015 Sutardja et al.
9,055,650 B2 6/2015 Steedly
9,072,149 B2 6/2015 Wu et al.
9,074,742 B1 7/2015 Petrocy et al.
9,101,011 B2 8/2015 Sawada et al.
9,125,270 B2 9/2015 Liao et al.
9,125,271 B2 9/2015 Martins et al.
9,127,823 B2 9/2015 Jaster
9,131,571 B2 9/2015 Zhang et al.
9,143,051 B2 9/2015 Newman, Jr.
9,144,127 B1 9/2015 Yu et al.
9,144,128 B2 9/2015 Shin et al.
9,144,131 B2 9/2015 Wray
9,146,012 B2 9/2015 Bartol et al.
9,161,412 B2 10/2015 Lou et al.
9,163,983 B2 10/2015 Olds et al.
9,189,996 B2 11/2015 Casper et al.
9,202,397 B1 12/2015 Petrocy et al.
9,210,760 B2 12/2015 Sanders et al.
9,210,768 B2 12/2015 Adler et al.
9,220,202 B2 12/2015 Maxik et al.
9,247,597 B2 1/2016 Miskin et al.
9,277,607 B2 3/2016 Ramer et al.
9,289,269 B2 3/2016 Valteau et al.
9,291,321 B2 3/2016 Jaster
9,301,353 B2 3/2016 Park et al.
9,301,355 B2 3/2016 Zhao
9,301,359 B2 3/2016 Wray
9,307,604 B2 4/2016 Sun et al.
9,322,525 B2 4/2016 Gommans et al.
9,326,343 B2 4/2016 Yan et al.
9,345,094 B2 5/2016 Lee et al.
9,374,876 B2 6/2016 Alpert et al.
9,386,653 B2 7/2016 Kuo et al.
9,414,452 B1 8/2016 Cheng et al.
9,414,457 B2 8/2016 Fukuda et al.
9,416,940 B2 8/2016 Di Trapani et al.
9,451,662 B1 9/2016 Chung et al.
9,456,478 B2 9/2016 Rodriguez et al.
9,468,062 B2 10/2016 Rybicki et al.
9,472,593 B2 10/2016 Hasnain et al.
9,480,116 B2 10/2016 Vissenberg et al.
9,485,826 B2 11/2016 Bohler et al.
9,491,821 B2 11/2016 Shackle
9,538,603 B2 1/2017 Shearer et al.
9,538,604 B2 1/2017 Yadav et al.
9,544,951 B1 1/2017 O'Neil et al.
9,544,969 B2 1/2017 Baddela et al.
9,554,441 B2 1/2017 Sutardja et al.
9,560,710 B2 1/2017 Beijer et al.
9,562,671 B2 2/2017 Davis
9,596,730 B1 3/2017 Ciccarelli et al.
9,603,213 B1 3/2017 Suttles et al.
9,618,184 B2 4/2017 Buchholz et al.
9,644,828 B1 5/2017 May
9,648,673 B2 5/2017 Pickard et al.
9,719,642 B1 8/2017 Macias
9,730,291 B1 8/2017 Janik et al.
9,736,904 B2 8/2017 Casper et al.
9,756,694 B2 9/2017 Serra et al.
9,801,250 B1 10/2017 Halliwell
9,820,350 B2 11/2017 Pyshos et al.
9,844,113 B2 12/2017 Yan et al.
9,844,114 B2 12/2017 Chowdhury et al.
9,854,637 B2 12/2017 Ciccarelli et al.
9,892,693 B1 2/2018 Kumar et al.
9,897,289 B2 2/2018 Biron et al.
9,900,945 B1 2/2018 Janik et al.
9,900,957 B2 2/2018 van de Ven et al.
9,907,132 B2 2/2018 Zulim et al.
9,913,343 B1 3/2018 Ciccarelli et al.
9,955,551 B2 4/2018 Spero
9,997,070 B1 6/2018 Komanduri et al.
10,091,855 B2 10/2018 Van Winkle
10,091,856 B2 10/2018 Ciccarelli et al.
10,117,300 B2 10/2018 Doheny et al.
10,163,405 B2 12/2018 Kumar et al.
10,187,952 B2 1/2019 Ciccarelli et al.
10,290,265 B2 5/2019 Kumar et al.
10,292,233 B1 5/2019 Udavant et al.
10,299,335 B2 5/2019 Pyshos et al.
10,299,336 B2 5/2019 Bowen et al.
10,299,337 B1 5/2019 Chen et al.
10,448,471 B1 10/2019 Chowdhury et al.
2002/0060283 A1 5/2002 Jordan et al.
2003/0016536 A1 1/2003 Lin
2004/0085793 A1 5/2004 Afzal et al.
2004/0263094 A1 12/2004 Lister
2005/0162851 A1* 7/2005 Kazar ..... H05B 47/155
362/231
2005/0243022 A1 11/2005 Negru
2006/0220586 A1 10/2006 Latham
2006/0226795 A1 10/2006 Walter et al.
2006/0238136 A1 10/2006 Johnson, III et al.
2006/0285310 A1 12/2006 Shyu
2007/0052376 A1 3/2007 Lee
2007/0138978 A1 6/2007 Rains, Jr. et al.
2007/0159750 A1 7/2007 Peker et al.
2007/0195552 A1 8/2007 Park
2007/0262724 A1 11/2007 Mednik et al.
2007/0273290 A1 11/2007 Ashdown et al.
2008/0094000 A1 4/2008 Yamamoto et al.
2008/0130298 A1 6/2008 Negley et al.
2008/0225520 A1 9/2008 Garbus
2008/0258643 A1 10/2008 Cheng et al.
2008/0265801 A1 10/2008 Lee et al.
2009/0002986 A1 1/2009 Medendorp, Jr. et al.

(56) References Cited

U.S. PATENT DOCUMENTS

2009/0026913 A1 1/2009 Mrakovich
2009/0195186 A1 8/2009 Guest et al.
2009/0218960 A1 9/2009 Lyons et al.
2009/0256483 A1 10/2009 Gehman et al.
2009/0278476 A1 11/2009 Baaijens
2009/0296368 A1 12/2009 Ramer
2009/0326616 A1 12/2009 Aarts et al.
2010/0007283 A1 1/2010 Shimoyoshi et al.
2010/0039799 A1 2/2010 Levens
2010/0061108 A1 3/2010 Zhang et al.
2010/0072903 A1 3/2010 Blaut et al.
2010/0084992 A1 4/2010 Valois et al.
2010/0103655 A1 4/2010 Smith
2010/0110699 A1 5/2010 Chou
2010/0141175 A1 6/2010 Hasnain et al.
2010/0148672 A1 6/2010 Hopper
2010/0172152 A1 7/2010 Boonekamp
2010/0207534 A1 8/2010 Dowling et al.
2010/0207544 A1 8/2010 Man et al.
2010/0214764 A1* 8/2010 Chaves ..... F21K 9/20 362/84
2010/0219770 A1 9/2010 Kim et al.
2010/0225241 A1 9/2010 Maehara et al.
2010/0244713 A1 9/2010 Lee et al.
2010/0259918 A1 10/2010 Rains, Jr. et al.
2010/0277316 A1 11/2010 Schlangen et al.
2010/0283322 A1 11/2010 Wibben
2010/0295460 A1 11/2010 Lin et al.
2010/0308738 A1 12/2010 Shteynberg et al.
2010/0308739 A1 12/2010 Shteynberg et al.
2010/0308749 A1 12/2010 Liu
2011/0015495 A1 1/2011 Dothie et al.
2011/0050125 A1 3/2011 Medendorp, Jr. et al.
2011/0058372 A1 3/2011 Lerman et al.
2011/0062872 A1* 3/2011 Jin ..... H05B 45/00 315/122
2011/0068702 A1 3/2011 van de Ven et al.
2011/0074292 A1 3/2011 Maehara
2011/0075414 A1 3/2011 Van De Ven et al.
2011/0075422 A1 3/2011 Van De Ven et al.
2011/0084615 A1 4/2011 Welten
2011/0095703 A1 4/2011 Wilson et al.
2011/0101883 A1 5/2011 Grajcar
2011/0115391 A1 5/2011 Chao et al.
2011/0115407 A1* 5/2011 Wibben ..... H05B 45/44 315/294
2011/0170289 A1 7/2011 Allen et al.
2011/0175510 A1 7/2011 Rains, Jr. et al.
2011/0182065 A1 7/2011 Negley et al.
2011/0187290 A1 8/2011 Krause
2011/0193467 A1 8/2011 Grajcar
2011/0199753 A1 8/2011 Ramer et al.
2011/0210678 A1 9/2011 Grajcar
2011/0227489 A1 9/2011 Huynh
2011/0241551 A1 10/2011 McRae
2011/0242810 A1 10/2011 Lopez Querol et al.
2011/0273102 A1 11/2011 Van De Ven et al.
2011/0273107 A1 11/2011 Hsia et al.
2011/0316440 A1 12/2011 Leshniak
2012/0020092 A1 1/2012 Bailey
2012/0038286 A1 2/2012 Hasnain
2012/0038291 A1 2/2012 Hasnain
2012/0056556 A1 3/2012 Laski et al.
2012/0080944 A1 4/2012 Recker et al.
2012/0081009 A1 4/2012 Shteynberg et al.
2012/0087113 A1 4/2012 McClellan
2012/0098460 A1 4/2012 Miyasaka et al.
2012/0112661 A1 5/2012 Van De Ven et al.
2012/0119658 A1 5/2012 McDaniel
2012/0134133 A1 5/2012 Kang
2012/0153836 A1 6/2012 Shimizu
2012/0229030 A1 9/2012 Moskowitz et al.
2012/0229032 A1 9/2012 Van De Ven et al.
2012/0242247 A1 9/2012 Hartmann et al.
2012/0253542 A1 10/2012 Nurmi et al.
2012/0280635 A1 11/2012 Lu et al.
2012/0286753 A1 11/2012 Zhong et al.
2012/0300452 A1 11/2012 Harbers et al.
2013/0002144 A1 1/2013 Adler
2013/0002157 A1 1/2013 Van de Ven et al.
2013/0002167 A1 1/2013 Van de Ven
2013/0015774 A1 1/2013 Briggs
2013/0021580 A1 1/2013 Morgan et al.
2013/0038222 A1 2/2013 Yeh et al.
2013/0049610 A1 2/2013 Chen
2013/0069561 A1 3/2013 Melanson et al.
2013/0076239 A1 3/2013 Chung et al.
2013/0082616 A1 4/2013 Bradford et al.
2013/0083554 A1 4/2013 Jaster
2013/0113394 A1 5/2013 Ido et al.
2013/0119872 A1 5/2013 Chobot et al.
2013/0119882 A1 5/2013 Mao et al.
2013/0140988 A1 6/2013 Maxik et al.
2013/0141013 A1 6/2013 Kodama et al.
2013/0147387 A1 6/2013 Murdock
2013/0147388 A1 6/2013 Frost et al.
2013/0175931 A1 7/2013 Sadwick
2013/0200806 A1 8/2013 Chobot
2013/0200807 A1 8/2013 Mohan et al.
2013/0223079 A1 8/2013 Jung et al.
2013/0229125 A1 9/2013 Yan et al.
2013/0249422 A1 9/2013 Kerstens et al.
2013/0278163 A1 10/2013 Rodriguez et al.
2013/0293963 A1 11/2013 Lydecker et al.
2013/0294058 A1 11/2013 Lou et al.
2013/0300308 A1 11/2013 Sadwick
2013/0307423 A1 11/2013 Lee
2013/0328500 A1 12/2013 Toda
2013/0343052 A1 12/2013 Yen
2014/0001959 A1* 1/2014 Motley ..... H05B 45/10 315/149
2014/0001974 A1 1/2014 Lu et al.
2014/0035472 A1 2/2014 Raj et al.
2014/0042920 A1 2/2014 Chou
2014/0049172 A1 2/2014 Bakk
2014/0062318 A1 3/2014 Tischler et al.
2014/0063779 A1 3/2014 Bradford
2014/0085873 A1 3/2014 Willis
2014/0117866 A1 5/2014 Hodrinsky et al.
2014/0125239 A1 5/2014 Sullivan et al.
2014/0197750 A1 7/2014 Cash
2014/0210357 A1 7/2014 Yan et al.
2014/0210364 A1 7/2014 Cash et al.
2014/0225529 A1 8/2014 Beczkowski
2014/0232288 A1 8/2014 Brandes et al.
2014/0232297 A1 8/2014 Chobot
2014/0233256 A1 8/2014 Orfield
2014/0252967 A1* 9/2014 van de Ven ..... H05B 45/20 315/188
2014/0254171 A1 9/2014 Greiner
2014/0265882 A1 9/2014 Laski et al.
2014/0265888 A1 9/2014 Ekbote
2014/0285102 A1 9/2014 Jain et al.
2014/0300283 A1 10/2014 Lee et al.
2014/0300284 A1 10/2014 Lee et al.
2014/0312775 A1 10/2014 Steedly
2014/0312777 A1 10/2014 Shearer et al.
2014/0320022 A1 10/2014 Lee
2014/0328045 A1 11/2014 Valteau et al.
2014/0333216 A1 11/2014 Zhang et al.
2014/0361696 A1 12/2014 Siessegger et al.
2014/0362567 A1 12/2014 Dobbertin et al.
2014/0375213 A1 12/2014 Zhang et al.
2015/0002045 A1 1/2015 Hwang et al.
2015/0009666 A1 1/2015 Keng et al.
2015/0022093 A1 1/2015 Smith et al.
2015/0035440 A1 2/2015 Spero
2015/0035443 A1 2/2015 Hill et al.
2015/0036316 A1 2/2015 Lin et al.
2015/0061500 A1 3/2015 Yeh
2015/0084534 A1 3/2015 Fukuda et al.
2015/0091472 A1 4/2015 Kadotani et al.
2015/0097489 A1 4/2015 Wu et al.
2015/0115800 A1 4/2015 Vos et al.

(56) References Cited

U.S. PATENT DOCUMENTS

| | | | |
|---|---|---|---|
| 2015/0115823 | A1 | 4/2015 | Serra et al. |
| 2015/0173151 | A1 | 6/2015 | Ter Weeme et al. |
| 2015/0186594 | A1 | 7/2015 | Zhang et al. |
| 2015/0234207 | A1 | 8/2015 | Koifman |
| 2015/0245437 | A1 | 8/2015 | Cho et al. |
| 2015/0245441 | A1 | 8/2015 | McCune, Jr. |
| 2015/0247623 | A1 | 9/2015 | Hikmet et al. |
| 2015/0264764 | A1 | 9/2015 | Choi et al. |
| 2015/0271884 | A1 | 9/2015 | Kim et al. |
| 2015/0282266 | A1 | 10/2015 | Hsing Chen et al. |
| 2015/0289344 | A1 | 10/2015 | Leadford et al. |
| 2015/0305098 | A1 | 10/2015 | Jung et al. |
| 2015/0312989 | A1 | 10/2015 | Wee et al. |
| 2015/0334808 | A1 | 11/2015 | Hack et al. |
| 2015/0348468 | A1 | 12/2015 | Chen et al. |
| 2015/0351169 | A1 | 12/2015 | Pope et al. |
| 2015/0351190 | A1 | 12/2015 | Walters et al. |
| 2015/0351193 | A1 | 12/2015 | Chao et al. |
| 2015/0354223 | A1 | 12/2015 | Biron et al. |
| 2015/0359061 | A1 | 12/2015 | Adler |
| 2015/0362143 | A1 | 12/2015 | Baaijens et al. |
| 2015/0369434 | A1 | 12/2015 | Baaijens et al. |
| 2015/0375008 | A1 | 12/2015 | Gretz et al. |
| 2015/0377435 | A1 | 12/2015 | Liu et al. |
| 2016/0007420 | A1 | 1/2016 | Gong et al. |
| 2016/0025273 | A1 | 1/2016 | Van De Ven et al. |
| 2016/0033100 | A1 | 2/2016 | Hansson |
| 2016/0071393 | A1 | 3/2016 | Kaplan et al. |
| 2016/0120001 | A1 | 4/2016 | Clark et al. |
| 2016/0123564 | A1 | 5/2016 | Quilici et al. |
| 2016/0128155 | A1 | 5/2016 | Petluri et al. |
| 2016/0151012 | A1 | 6/2016 | Bozkurt et al. |
| 2016/0153194 | A1 | 6/2016 | Kristensen |
| 2016/0153631 | A1 | 6/2016 | Chen |
| 2016/0158486 | A1 | 6/2016 | Colbaugh et al. |
| 2016/0158487 | A1 | 6/2016 | Colbaugh et al. |
| 2016/0158572 | A1 | 6/2016 | Nolan et al. |
| 2016/0159276 | A1 | 6/2016 | Thomas et al. |
| 2016/0165696 | A1 | 6/2016 | Rodriguez et al. |
| 2016/0169465 | A1 | 6/2016 | Jones et al. |
| 2016/0174305 | A1 | 6/2016 | Kim et al. |
| 2016/0199000 | A1 | 7/2016 | Gimenez et al. |
| 2016/0302288 | A1 | 10/2016 | Gotoh et al. |
| 2016/0323949 | A1 | 11/2016 | Lee |
| 2016/0363308 | A1 | 12/2016 | Shum |
| 2016/0366746 | A1 | 12/2016 | Van de Ven et al. |
| 2016/0374177 | A1 | 12/2016 | Chen |
| 2016/0381750 | A1 | 12/2016 | Bong et al. |
| 2017/0019973 | A1 | 1/2017 | Beck et al. |
| 2017/0027033 | A1 | 1/2017 | Chobot et al. |
| 2017/0064785 | A1 | 3/2017 | Kim et al. |
| 2017/0071046 | A1 | 3/2017 | Petschulat et al. |
| 2017/0086265 | A1 | 3/2017 | Akiyama et al. |
| 2017/0086280 | A1 | 3/2017 | Boomgaarden et al. |
| 2017/0127489 | A1 | 5/2017 | Zulim et al. |
| 2017/0135186 | A1 | 5/2017 | O'Neil et al. |
| 2017/0138572 | A1 | 5/2017 | Biron et al. |
| 2017/0164440 | A1 | 6/2017 | Hu et al. |
| 2017/0171933 | A1 | 6/2017 | Chowdhury et al. |
| 2017/0219170 | A1 | 8/2017 | Petluri et al. |
| 2017/0238392 | A1 | 8/2017 | Shearer et al. |
| 2017/0303363 | A1 | 10/2017 | Pyshos et al. |
| 2017/0339766 | A1 | 11/2017 | Ciccarelli et al. |
| 2018/0035510 | A1 | 2/2018 | Doheny et al. |
| 2018/0070420 | A1 | 3/2018 | Ciccarelli et al. |
| 2018/0103523 | A1 | 4/2018 | Yan et al. |
| 2018/0116029 | A1 | 4/2018 | Pyshos et al. |
| 2018/0153015 | A1 | 5/2018 | Ciccarelli et al. |
| 2018/0160491 | A1 | 6/2018 | Biery et al. |
| 2018/0166026 | A1 | 6/2018 | Kumar et al. |
| 2018/0242422 | A1* | 8/2018 | Choi ..... H05B 45/00 |
| 2018/0249547 | A1 | 8/2018 | Wang et al. |
| 2018/0267223 | A1 | 9/2018 | Rodgers et al. |
| 2018/0310381 | A1 | 10/2018 | Bowen et al. |
| 2018/0368232 | A1 | 12/2018 | Doheny et al. |
| 2019/0027099 | A1 | 1/2019 | Kumar et al. |
| 2019/0037663 | A1 | 1/2019 | Van Winkle |
| 2019/0088213 | A1 | 3/2019 | Kumar et al. |
| 2019/0104577 | A1 | 4/2019 | Miller et al. |
| 2019/0141802 | A1 | 5/2019 | Saes et al. |
| 2019/0141812 | A1 | 5/2019 | Chen |
| 2019/0191512 | A1 | 6/2019 | Zeng et al. |
| 2019/0268984 | A1 | 8/2019 | Song et al. |
| 2019/0268991 | A1 | 8/2019 | Li |
| 2019/0306949 | A1 | 10/2019 | Murray et al. |
| 2019/0394851 | A1 | 12/2019 | Sinphay |

FOREIGN PATENT DOCUMENTS

| | | |
|---|---|---|
| CA | 2960262 | 12/2017 |
| CN | 106555981 | 4/2017 |
| EP | 2658348 | 10/2013 |
| EP | 2768283 | 8/2014 |
| EP | 2728972 | 8/2015 |
| EP | 3247174 | 11/2017 |
| EP | 3247175 | 11/2017 |
| JP | 2011258517 | 12/2011 |
| KR | 20100009895 | 10/2010 |
| WO | 2006018604 | 2/2006 |
| WO | 2010103480 | 9/2010 |
| WO | 2011084135 | 7/2011 |

OTHER PUBLICATIONS

3 Inch WarmDim/Tunable White, Aculux, Accessed from Internet on May 15, 2020, 3 pages.

38W LED Panel—Color Selectable, Venture Lighting, Available Online at: https://www.venturelighting.com/led-lighting/indoor-lighting-fixtures/panels-and-troffers/color-selectable-panels/standard-product/pn38592.html, Accessed from Internet on May 14, 2019, 6 pages.

6" IC LED Retrofit Warmdim (TM) Downlight Trim, Juno, Oct. 2012, 2 pages.

Easy Lighting Control, Application Guide, OSRAM, Available Online at: www.osram.com/easy, Apr. 2015, 25 pages.

Human Centric Lighting, Helvar, Intelligent Colour Product Series, Available Online at: helvar.com/second-sun, Dec. 4, 2017, 4 pages.

IW Cove MX Powercore-Premium Interior Linear LED Cove and Accent Luminaire with Intelligent White Light, Philips Lighting, Product Family Leafelet, Jan. 21, 2019, 3 pages.

LED Panel 1230 40W Colour Changeable, Fuzion Lighting, Information sheet, Available Online at: http://www.fuzionlighting.com.au/product/led-panel-40-cct, Accessed from Internet on Mar. 19, 2019, 6 pages.

LED Universal Ceiling Fan Light Kit, Hampton Bay, Use and Care Guide, Nov. 7, 2019, 22 pages.

LLP LED Light Panel, Main Place Lighting, Specification Sheet, Available Online at: https://cdn.shopify.com/s/files/1/2048/2207/files/LLP-Specification-Sheet-1.pdf, Accessed from Internet on Mar. 19, 2019, 4 pages.

Noble Pro LED Line Voltage Task Lighting NLLP Series, AFX, Available Online at: www.AFXinc.com, Accessed from Internet at May 13, 2019, 1 page.

Par Lite Led, VariWhite, Coemar, User Manual Version 1.0, Jun. 2011, 19 pages.

ViaCon LED-Products, Trilux Simplify your Light, Available Online at: https://www.trilux.com/en/products/viacon-led/, Accessed from Internet on May 13, 2019, 11 pages.

Warmdim® & Tunable White Adjustable/downlight/wall Wash 1000 Lumen Led 3" Baffle Down Light Trim AX3 WDTW with 3DBAF Trim, Aculux Luminaire, Mar. 20, 2019, 3 pages.

Biery et al., Controlling LEDs, Lutron Electronics Co. Inc., May 2014, 20 pages.

Sun, Challenges and Opportunities for High Power White LED Development, DOE SSL R&D Workshop, Feb. 1, 2012, pp. 1-12.

* cited by examiner

LIGHTING FIXTURE CONTROLLER FOR CONTROLLING COLOR TEMPERATURE AND INTENSITY

CROSS REFERENCE TO RELATED APPLICATIONS

This application claims priority to U.S. Prov. App. No. 62/815,783, titled "Lighting Fixture Controller for Controlling Color Temperature and Intensity" and filed on Mar. 8, 2019, which is incorporated herein in its entirety.

TECHNICAL FIELD

This disclosure relates generally to the field of lighting fixtures. More specifically, this disclosure relates to controlling multiple groups of LEDs to produce different color temperatures and intensities using a single lighting fixture.

BACKGROUND

Lighting fixtures can produce different color temperatures of white light and different intensities to suit the preferences of different consumers or activities. For example, a cool white light may be preferred by some consumers or appropriate for some activities, whereas a warm white light may be preferred by other consumers or appropriate for other activities. Similarly, a consumer might want to reduce the intensity of a lighting fixture in certain circumstances or to increase the intensity of the lighting fixture in other circumstances. In some instances, different lighting fixtures are required to provide light with different color temperatures and intensities.

SUMMARY

Certain embodiments involve a light fixture controller configured for controlling the color temperature and the intensity of a light fixture. The light fixture includes a first LED group, a second LED group, and a driver for powering the first LED group and the second LED group. The first LED group includes a first set of LEDs and configured to produce light at a first color temperature. The second LED group includes a second set of LEDs and is configured to produce light at a second color temperature. The light fixture controller includes one or more interfaces configured for receiving a color temperature setting and an intensity setting for the light fixture. The light fixture controller further includes a microcontroller configured for generating control signals based on the color temperature setting and the intensity setting for the light fixture. The control signals include a first control signal and a second control signal. The first control signal is configured for controlling an on/off state of the first LED group by controlling an open/closed state of a first switch connected to the first LED group. The second control signal is configured for controlling an on/off state of the second LED group by controlling an open/closed state of a second switch connected to the second LED group. The first control signal only turns on the first LED group for a first duration of an ON/OFF cycle and the second control signal only turns on the second LED group for a second duration of the ON/OFF cycle. The ratio between the first duration and the second duration is determined based on the color temperature setting for the light fixture. The ON/OFF cycle includes multiple time periods, and during each of the multiple time periods, at least one LED group of the light fixture is set to be on and at least one another LED group of the light fixture is set to be off. The control signals further include a dimming control signal configured for controlling the driver of the light fixture to adjust the current flowing through the first LED group and the second LED group based on the intensity setting for the light fixture.

These illustrative embodiments are mentioned not to limit or define the disclosure, but to provide examples to aid understanding thereof. Additional embodiments are discussed in the Detailed Description, and further description is provided there.

BRIEF DESCRIPTION OF THE DRAWINGS

Features, embodiments, and advantages of the present disclosure are better understood when the following Detailed Description is read with reference to the accompanying drawings, where:

FIGS. 2A and 2B are collectively referred to herein as FIG. 2.

DETAILED DESCRIPTION

Figure 1:
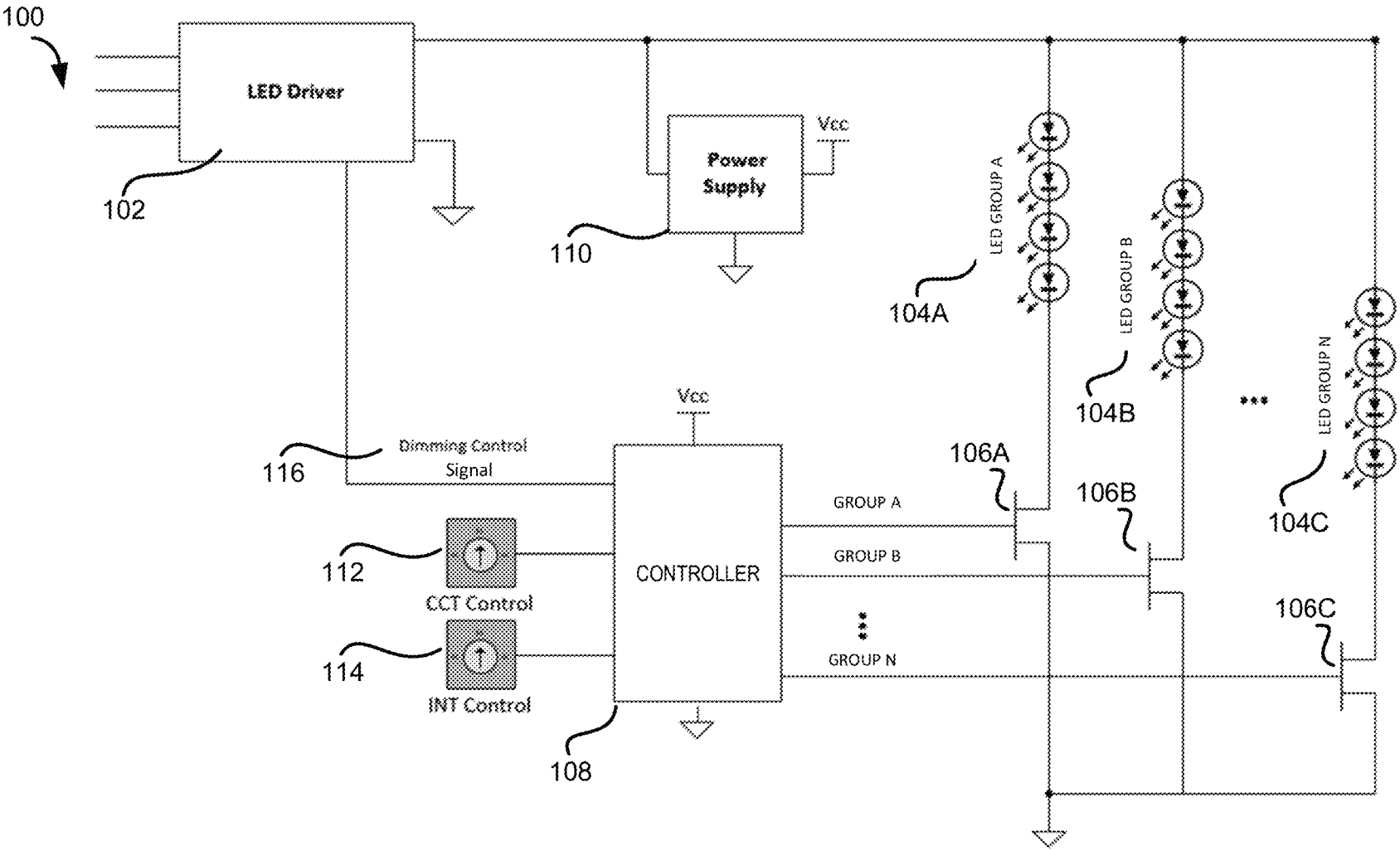
FIG. 1 depicts an example of a circuit that uses a controller presented herein to control the color temperature and intensity of a light fixture, according to the present disclosure.

Briefly described, the present disclosure generally relates to a controller that is configured for controlling multiple light-emitting diode (LED) groups of a light fixture with a single-channel driver to produce different color temperatures and intensities. Based on a color temperature setting, the controller can control the flow of the output current of the driver through each of the LED groups so that the light fixture produces light with a color temperature that matches the color temperature setting of the controller. In addition, the controller further controls the current flowing through the groups of LEDs to control the intensity of the light fixture based on an intensity setting at the controller.

In some configurations, a controller is configured to control multiple color temperature switches in order to control the color temperature of the light fixture. Each color temperature switch is configured to control the current flow of the corresponding LED group. For example, the controller can control the color temperature switches so that at a given time, only a first LED group is e ON while the remaining LED groups are OFF and, at another time, only a second LED group is ON while the remaining LED groups are OFF. The time duration when the first LED group is ON and the time duration when the second LED group is ON determine the resulting color temperature of the light fixture. As such, by controlling the current flow through each of the LED groups, the controller can control the color temperature of the light fixture to match the color temperature setting of the controller.

To control the intensity of the light fixture, in one configuration, the controller provides a dimming control input to the driver of the light fixture, such as a 0-10V dimming control input. The dimming control input can cause the driver to adjust the current output by the driver and flowing through the LED groups thereby adjusting the intensity of the light fixture. In another configuration, the LED groups of the light fixture can each be connected to one or more intensity switches that control the ON/OFF state of a portion of LEDs in each LED group. The controller can thus control the intensity of the light fixture by controlling the number of LEDs in an LED group that are ON via the intensity switches. Similarly, the controller can also control other aspects of the light fixture, such as the light pattern, light distribution or light direction by controlling these intensity switches.

The controller can be pre-set or programmed through various interfaces such as switches, tactile buttons, breakaway PCB tabs or traces. The controller can also be controlled by advanced features such as digital wired network communication interfaces, wireless communication interfaces, optical communication interfaces, an OEM "push-on-programmer" or a wireless NFC-TAG interface. External control or programming interface devices could be made through cell phones, computer or lighting controller interfaces, or other OEM designed devices.

By using the controller presented herein, different outputs that are traditionally provided by different light fixtures, such as different color temperatures, intensities, light patterns, concentrations, and so on, can be provided by a single light fixture. Further, the controller presented herein does not require a special driver to achieve these multiple outputs of the light fixture. Rather, a single-channel off-the-shelf driver can be used in the light fixture and controlled by the controller.

Referring now to the figures, FIG. 1 depicts an example of a circuit that uses a controller presented herein to control the color temperature and intensity of a light fixture 100. The light fixture 100 includes a single channel LED driver 102 that provides a current to multiple LED groups 104A-104C, which may be referred to herein individually as an LED group 104 or collectively as the LED groups 104. An LED group 104 may include multiple LEDs. The LEDs in an LED group 104 may be connected in series, in parallel, or in any combination thereof. Individual LEDs in an LED group 104 may have the same color temperature or may have different color temperatures. The number of LEDs in an LED group may be the same or differ between LED groups within the same light fixture so long as the LED groups appear balanced to the driver. When the LED group 104 is powered, the LEDs of the group collectively provide light at a color temperature. The disclosure is also applicable to light fixtures that use other types of lighting elements including, but not limited to, organic light-emitting diodes (OLEDs).

In some configurations, different LED groups 104 have different color temperatures. In an example where the LED groups 104 have two LED groups such as LED group 104A and LED group 104B, LED group 104A can be configured to produce light with a color temperature of 5000K and LED group 104B can be configured to produce light with a color temperature of 2700K. Color temperatures of 5000K and above are generally considered "cool white", and color temperatures between 2000K-3000K are generally considered "warm white." By controlling the ON/OFF cycles of LED group 104A and LED group 104B, different color temperatures of the light fixture 100 can be achieved.

To control the ON/OFF state of the LED groups 104, the light fixture 100 shown in FIG. 1 further includes multiple switches 106A-106C, which may be referred to herein individually as a switch 106 or collectively as the switches 106. Each of the switches 106 is connected in series with the LEDs in the corresponding LED group and provides a switchable path between the output of the driver 102 and the corresponding LED group 104 thereby controlling the ON/OFF state of the corresponding LED group 104. In the example shown in FIG. 1, switch 106A controls the ON/OFF state of LED group 104A, switch 106B controls the ON/OFF state of the LED group 104B, and switch 106C controls the ON/OFF state of the LED group 104C.

The light fixture 100 can further include a controller 108 for controlling various aspects of the light fixture 100, such as the color temperature, the intensity, light pattern, light distribution, light direction and so on. In one configuration, the controller 108 is a microcontroller-based device that is compatible with off-the-shelf LED drivers to add various functionalities to the light fixture 100. The controller circuitry can be integrated on an LED light engine board or on a stand-alone printed circuit board (PCB) (not shown in FIG. 1). The controller 108 can be self-powered or can use power from the LED driver 102. In the example shown in FIG. 1, a power supply component 110 is added to the light fixture 100 to convert the output of the LED driver 102 to a power supply that can be used to power the controller 108. In other examples, the controller 108 can be powered by an external power source, such as an external battery.

The controller 108 can be configured to accept various control inputs, such as a color temperature control 112 and an intensity control 114. The color temperature control 112 can specify a color temperature setting so that the controller 108 can control the light fixture 100 to produce light with a color temperature that matches the color temperature setting. Similarly, the intensity control 114 can specify an intensity setting so that the controller 108 can control the light fixture 100 to produce light with an intensity that matches the intensity setting. In one example, the controller 108 can be pre-set or programmed with the intensity and color temperature settings or other settings through various interfaces, such as slide switches or PCB jumpers. Detailed examples of the interfaces that can be utilized to set or program the settings of the controller 108 are provided below with regard to FIGS. 5 and 6.

In the example shown in FIG. 1, the controller 108 controls the intensity of the light fixture 100 based on the intensity setting of the controller 108 through a dimming control signal 116 sent to the LED driver 102. The dimming control signal 116 can be, for example, a 0-10V control signal that varies between 0 to 10V. Based on the dimming control signal 116, the LED driver 102 controls the amount of current provided to the LED groups, for example, in proportion to the voltage value of the dimming control signal 116. As such, a dimming control signal 116 having a 10V can lead to a full intensity of the light fixture 100, whereas a 5V dimming control signal 116 results in a 50% intensity of the light fixture 100. Other types of dimming inputs are also possible.

FIG. 1 further illustrates that the controller 108 controls the color temperature of the light fixture 100 through outputting control signals to control the switches 106 of the LED groups 104. As shown in FIG. 1, the controller 108 can output multiple control signals each of which is configured to control one of the switches 106. A control signal of the controller 108 can control the open/closed state of the corresponding switch 106 thereby controlling the on/off state of the corresponding LED groups. When a switch 106 is closed, the current provided by the LED driver 102 can flow through the corresponding LED group to drive the LED group in the ON state to emit light. When the switch 106 is open, the current provided by the LED driver 102 does not flow through the corresponding LED group and thus the LED group stays in the OFF state without emitting light.

To achieve the color temperature specified in the color temperature setting, the controller 108 determines an ON/OFF cycle. At a given duration of the cycle, the controller 108 can control one of the LED groups 104 to be ON while the remaining LED groups 104 are kept OFF. At another duration of the cycle, another LED group can be set ON while the remaining LED groups are kept OFF. By controlling the ON/OFF cycle of the LED groups, the controller 108 can control the light fixture 100 to produce light at a certain color temperature. To change the color temperature of the light fixture 100, the controller 108 can adjust the ON/OFF cycle to change the time duration for the individual LED group to be in an ON state. Because the switches 106 are utilized here to control the color temperature of the light fixture 100, these switches are also referred to herein as "color temperature switches 106." Additional details regarding the operations of the light fixture 100 are provided below with regard to FIGS. 2-6.

Figure 2B:
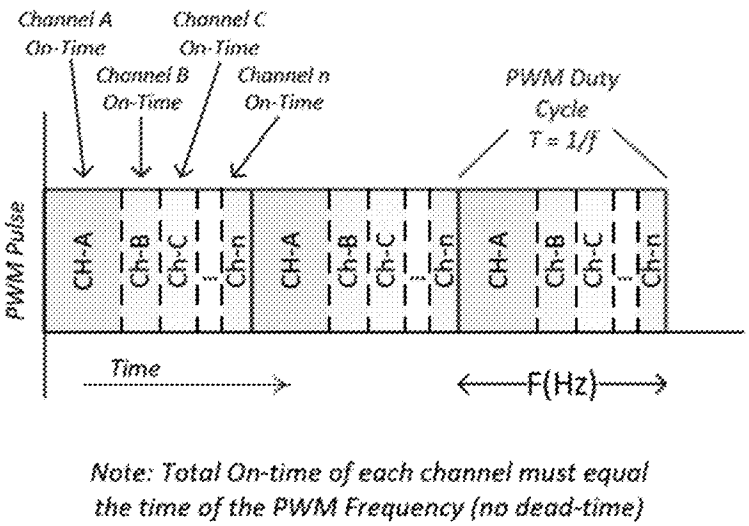
FIG. 2B depicts another example of controlling the color temperature of a light fixture by a controller via pulse width modulation signals, according to the present disclosure.
Figure 2A:
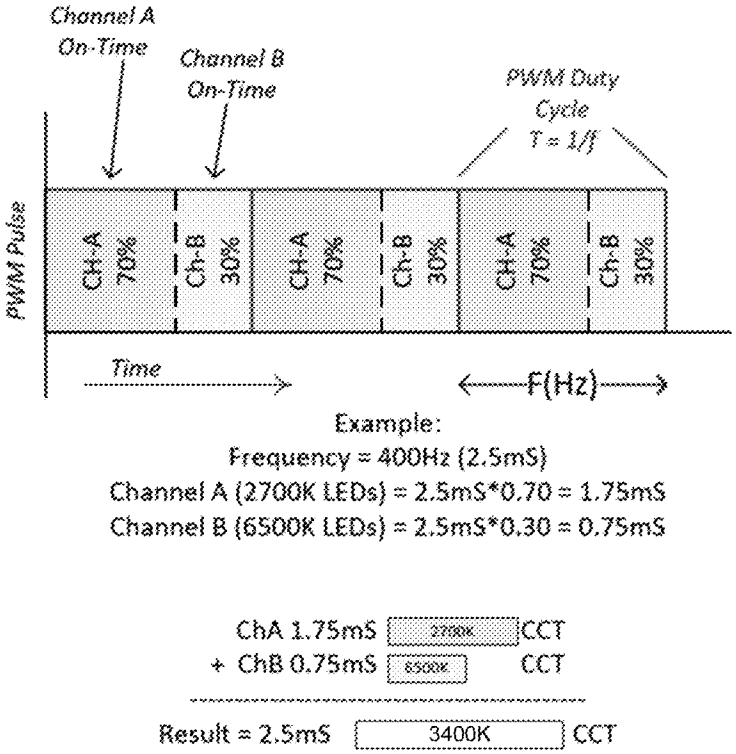
FIG. 2A depicts an example of controlling the color temperature of a light fixture by a controller via pulse width modulation signals, according to the present disclosure.

FIG. 2A illustrates an example of controlling the color temperature of a light fixture 100 by controlling the open/closed state of the color temperature switches 106 connected to the LED groups of the light fixture using pulse width modulation (PWM) signals. In this example, the light fixture 100 has two LED groups, referred to herein as channel A LED group and channel B LED group. Each of the two LED groups has a color temperature switch connected in series with the LEDs in the corresponding LED group. The controller 108 controls the two color temperature switches using a PWM signal with a frequency f, such as 400 Hz, and an ON/OFF cycle T=1/f. In the example shown in FIG. 2A, within one ON/OFF cycle, one of the LED groups is ON and the other is OFF. In particular, channel A LED group is in the ON state for the first 70% of the cycle time and channel B LED group is in the ON state for the remaining 30% of the cycle time. If the color temperature of channel A LED group is 2700K and the color temperature of channel B LED group is 6500K, the light fixture 100 can produce light with a color temperature of 2700K for 70% of the cycle and a color temperature of 6500K for 30% of the cycle. The combined color temperature may become, for example, 3400K. It should be noted that the combined color temperature value is also determined by the respective flux of the LED groups. As such, the open/close cycle of the switches 106 connected to the LED groups can be determined based on the target combined color temperatures of the light fixture as well as the flux of the LED groups. Due to the high frequency of the PWM signal which is typically on the scale of several hundreds of Hz, the changes between the two color temperatures within a cycle are unnoticeable to human eyes and only the combined color temperature is perceivable by a user.

FIG. 2B illustrates another example of controlling the color temperature of the light fixture 100 by controlling the open/closed state of the switches 106 using pulse width modulation (PWM) signal. In this example, the light fixture 100 has N LED groups, denoted as channel A, channel B, . . . , channel N in FIG. 2B. The cycle of the PWM signal is divided into N time durations and within each time duration, one of the N LED groups is ON whereas others are OFF. The total ON time of the N LED groups equals to the time of an ON/OFF cycle. The color temperature of the light fixture 100 can thus be determined based on the ON time of the N LED groups, their respective color temperatures, and their respective flux.

It should be understood that while the examples in FIGS. 2A and 2B show one LED group is ON at a given time duration of the ON/OFF cycle, multiple LED groups can be turned on and the output color temperature of the light fixture 100 can be determined in a similar way as described above, i.e. by determining the color temperature for each time duration of the cycle and calculating the combined color temperature based on the percentage of each time duration in the entire cycle. Likewise, for a given color temperature, the controller can calculate the duration for each LED group to be ON within a cycle based on the color temperature and flux of individual LED groups, thereby generating the control signals to control the open/closed state of the switches 106.

Figure 3:
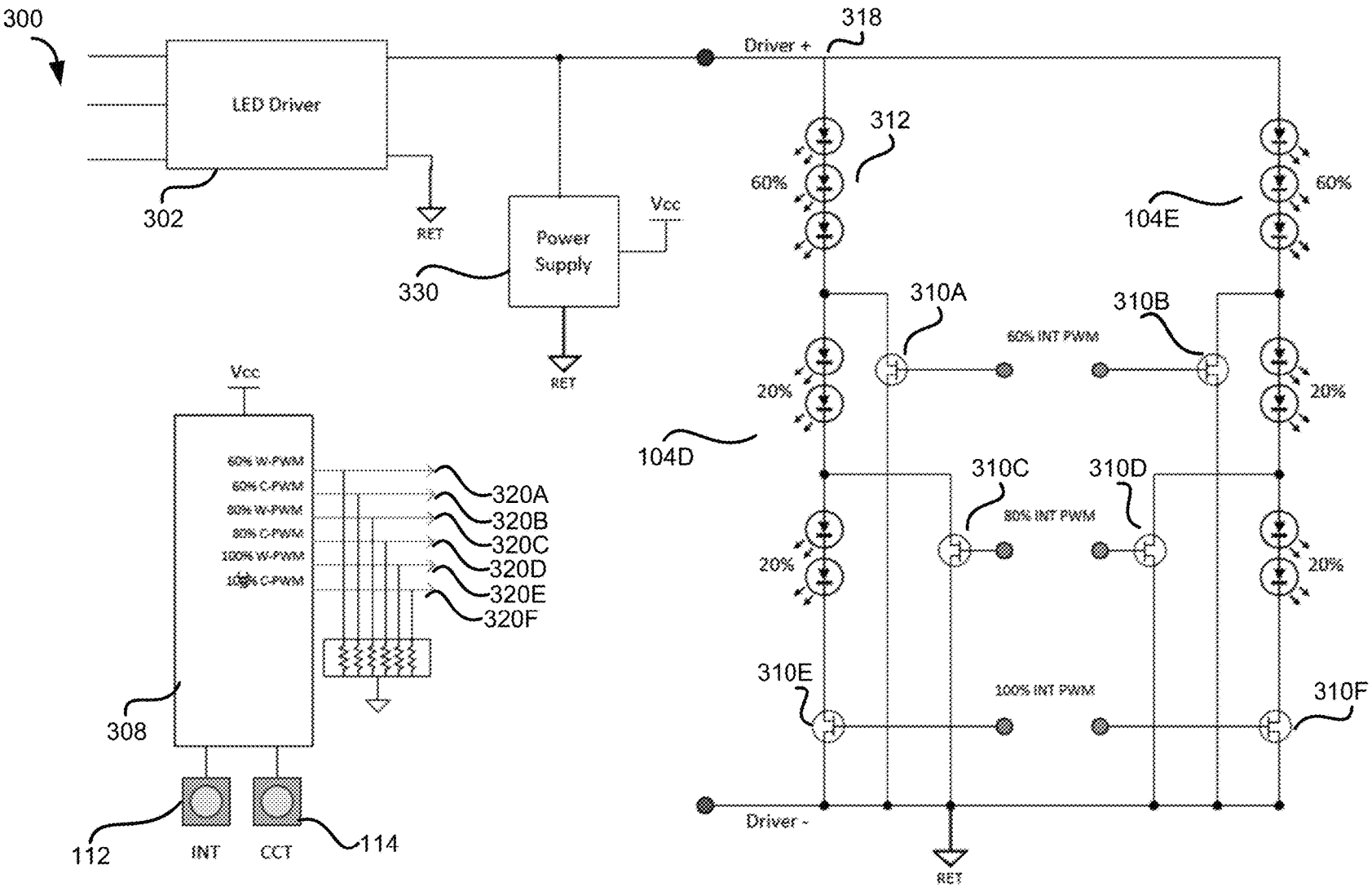
FIG. 3 depicts another example of a circuit that uses a controller presented herein to control the color temperature and intensity of a light fixture, according to the present disclosure.

FIG. 3 depicts another example of a circuit that uses a controller presented herein to control the color temperature and intensity of a light fixture 300. In this example, the light fixture 300 has two LED groups 104D and 104E. Each of the two LED groups includes multiple LEDs that are similar to the LEDs described above with regard to FIG. 1. Other components of the light fixture 300, such as the LED driver 302 and the power supply 330 are also similar to the corresponding components of the light fixture 100 shown in FIG. 1.

Different from the light fixture 100 shown in FIG. 1, each LED group of the light fixture 300 includes multiple switches 310A-310F that are connected in series to a portion of the LEDs in an LED group and in parallel to other portions of the LEDs in the group. For example, the switch 310A is connected in series with the top 60% LEDs of the LED group 104D and in parallel to the remaining 40% LEDs in the group. As a result, when the switch 310A is closed (and other switches in LED group 104D are open), the current from the driver 302 will flow through the top 60% LEDs but not the remaining 40% LEDs. When the switches 310A and 310C are open and switch 310E is closed, the current from the driver 302 will flow through all the LEDs in the LED group 104D. In this way, the switches 310 can be utilized to control the number of LEDs that are on thereby controlling the intensity of the light fixture 300. Because the switches 310 can be utilized to control the intensity of the light fixture 300, they are also referred to herein as "intensity switches 310."

The controller 308 of the light fixture 300 is also similar to the controller 108 of the light fixture 100 shown in FIG. 1 except that the controller 308 is further configured to control the intensity switches 310. As shown in the example of FIG. 3, the controller 308 generates output signals 320A-320F for controlling the intensity switches 310A-310F, respectively. If the intensity setting of the controller 308 is set to be 60% intensity, the controller 308 can control the intensity switches 310A and 310B to be closed and other switches are open so that only the top 60% LEDs of each LED group are on thereby generating light with 60% intensity. In one configuration, the open/closed states of the intensity switches 310A and 310B are synchronized so that they are closed and opened at the same time. Similarly, the open/closed states of the intensity switches 310C and 310D are synchronized and the open/closed states of the intensity switches 310E and 310F are also synchronized. This can ensure that the voltages on the different LED groups are balanced to avoid disturbance to the LED driver 302.

Because the intensity of the light fixture 300 can be controlled using the intensity switches, the dimming control signal provided by the controller to the LED driver can be eliminated as shown in FIG. 3. In other configurations, the dimming control signal can also be provided to the LED driver as an additional mechanism to control the intensity of the light fixture 300.

It should be understood that while FIG. 3 only shows two LED groups, the light fixture 300 can include more than two LED groups and controlling the multiple LED groups can be performed similarly. For example, the light fixture 300 can include a third LED group with a similar configuration as the LED groups 104D and 104E, i.e. containing three intensity switches placed at 60%, 80% and 100% intensity positions as the intensity switches of the LED groups 104D and 104E. To control this third LED group, the controller 308 can include three additional outputs to control the three intensity switches, respectively. More LED groups can be added similarly.

It should be further understood that while the above examples use three intensity switches to control the intensity of the light fixture 300 at 60%, 80%, and 100% intensities, more or fewer than three intensity switches can be added to each LED group at other locations to control the intensity of the light fixture 300 to be at any intensity values, such as 10%, 20%, 50%, and so on.

To control the color temperature of the light fixture 300 shown in FIG. 3, the controller 308 can control the intensity switches that are closed in the same way as the controller 108 controls the color temperature switches 106 as described above with regard to FIGS. 1, 2A and 2B. In other words, the controller 308 can control the intensity switches that should be closed by following the ON/OFF cycle described with regard to FIG. 2A. For example, if the light fixture 300 is set at 60% intensity, the controller 308 controls the switches 310A-310B to be closed and keeps the switches 310C-310F open. The controller further controls the switches 310A and 310B to follow an open/close cycle, such as the cycle shown in FIG. 2A, so that only one LED group has 60% of LEDs on at a given time point. The time duration that one group is on and the other is off is determined by the color temperature settings. In this configuration, the intensity switches 310 are also used to control the color temperature of the light fixture.

In another configuration, a separate color temperate switch (not shown in FIG. 3) can be connected to each LED group, for example, between point 318 and the first LED in each group. In this way, the controller 308 only needs to control these separate color temperature switches as described with regard to FIG. 2 and controls the intensity switches to remain on or off based on the intensity setting of the light fixture.

In the example shown in FIG. 3, the intensity of the light fixture 300 is essentially controlled by turning on some of the LEDs while turning off other LEDs. In some fixture configurations, this can cause pixelation artifacts where some portions of the light fixture 300 are bright whereas other portions of the light fixture 300 are dark. This problem can be addressed by adding a mixing chamber (not shown in FIG. 3) to the light fixture 300 to diffuse the light emitted by the LED groups so that the location of the light source, i.e. the LEDs, cannot be discerned from outside the light fixture 300.

Figure 4A:
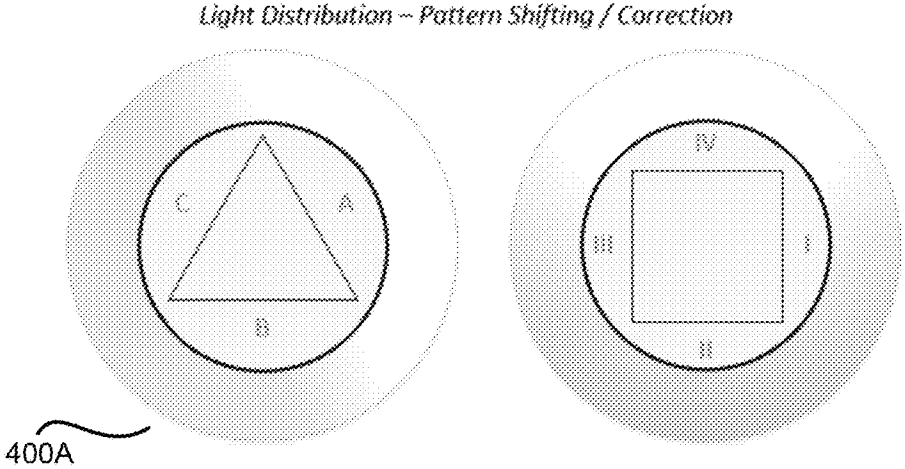
FIG. 4A depicts an example of shifting or correcting the light pattern of a light fixture using a controller presented herein.
Figure 4B:
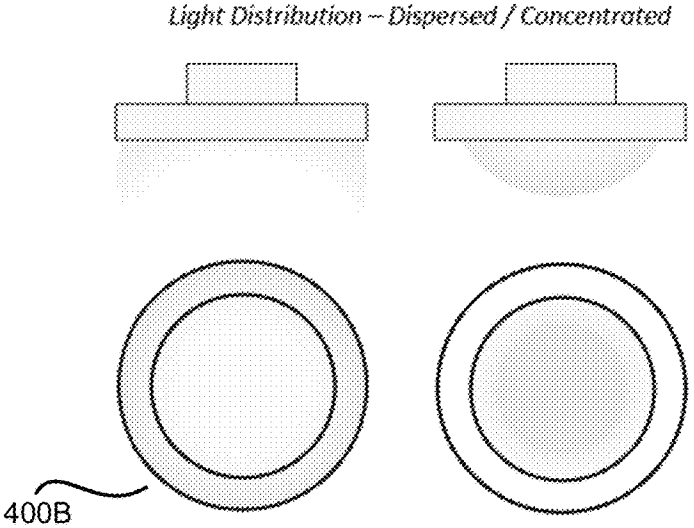
FIG. 4B depicts an example of changing the light concentration of a light fixture using the controller presented herein.
Figure 4C:
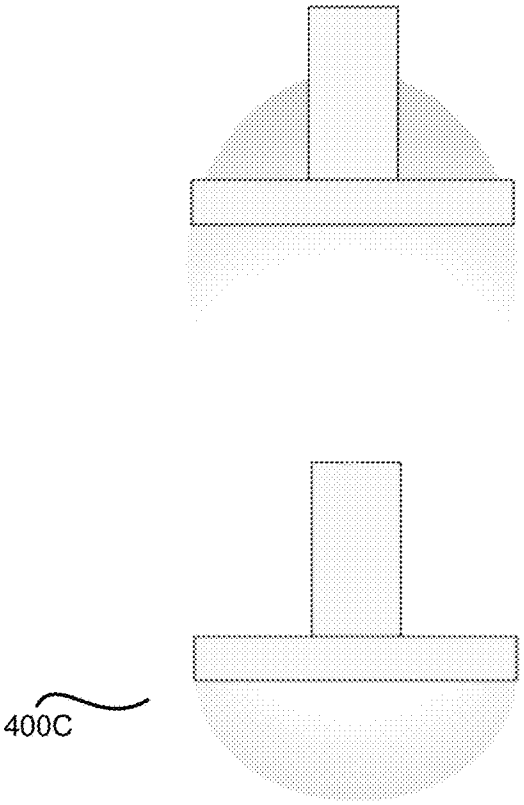
FIG. 4C depicts an example of changing the light direction of a light fixture using the controller presented herein.

In addition to controlling the intensity of the light fixture 300, the intensity switches shown in FIG. 3 can also be utilized to control other aspects of the light fixture 300. For example, the controller can be utilized to perform dynamic optical element control of the light fixture to control the light distribution such as the light pattern, light concentration, light direction, etc. FIGS. 4A-4C illustrate examples of controlling the light distribution of a light fixture that is configured similarly to the light fixture 300. That is, the light fixture has multiple LED groups, each LED group having one or more intensity switches that can be controlled by the controller to turn on or off portions of the LEDs in each LED group and the different portions of the LEDs located at different locations.

FIG. 4A depicts an example of shifting or correcting the light pattern of a light fixture 400A using a controller presented herein. In this example, the light fixture 400A can include multiple LED groups whose LEDs are distributed along the peripheral area of the light fixture 400A. Depending on the patterns to be adjusted, the LEDs of the LED groups can be connected in parallel or in series with multiple intensity switches. Each of the intensity switches can be configured to control the ON/OFF state of a section of the LEDs. The controller can be programmed to control the light fixture 400A to produce a light pattern shown on the left side of FIG. 4A, i.e. section A is dark whereas sections B and C are bright. Under this setting, the controller can control the intensity switches so that the LEDs in section A are off and the LEDs in sections B and C are on. If the controller is further programmed to change the light pattern to the one shown on the right side of FIG. 4A, the controller can control the intensity switches so that the LEDs in section IV are off and the LEDs in sections I, II and III are on. Other light patterns can be created and controlled in a similar way.

FIG. 4B depicts an example of changing the light concentration of a light fixture 400B using the controller presented herein. In this example, the light fixture 400B can include multiple LED groups whose LEDs are distributed across the entire LED board of the light fixture. These LEDs can be connected in parallel or in series with multiple intensity switches. For example, a portion of an LED group can be installed in the center area of the light fixture pointing to a center point of the light fixture. Another portion of the LED group can be scattered in the peripheral area of the light fixture pointing away from the center point. When only the center LEDs are on, concentrated light is produced from the light fixture, and when only the peripheral LEDs are on, dispersed light is produced from the light fixture. Intensity switches can be connected to each LED group so that the controller can change the concentration of the light fixture (i.e. concentrated lights or dispersed lights) by changing the open/closed state of the intensity switches. With such a configuration, the controller can thus be programmed to control the concentration of the light fixture by controlling the intensity switches of the LED groups.

FIG. 4C depicts an example of changing the light direction of a light fixture 400C using the controller presented herein. In this example, the light fixture can include multiple LED groups whose LEDs are distributed across the surface of the light fixture. A first portion of the LEDs in an LED group are installed pointing downward whereas the second portion of the LEDs are installed pointing upward. As a result, when only the first portion of the LEDs are on, the light fixture can produce downwardly directed light. When only the second portion of the LEDs are on, the light fixture can produce upwardly directed light. To switch the light fixture between the different light directions, intensity switches can be connected to each LED group so that the controller can change the light direction of the light fixture by changing the open/closed state of the intensity switches to have one portion of the LEDs on with the other portion off. With such a configuration, the controller can thus be programmed to control the light direction of the light fixture by controlling the intensity switches of the LED groups.

Figure 5:
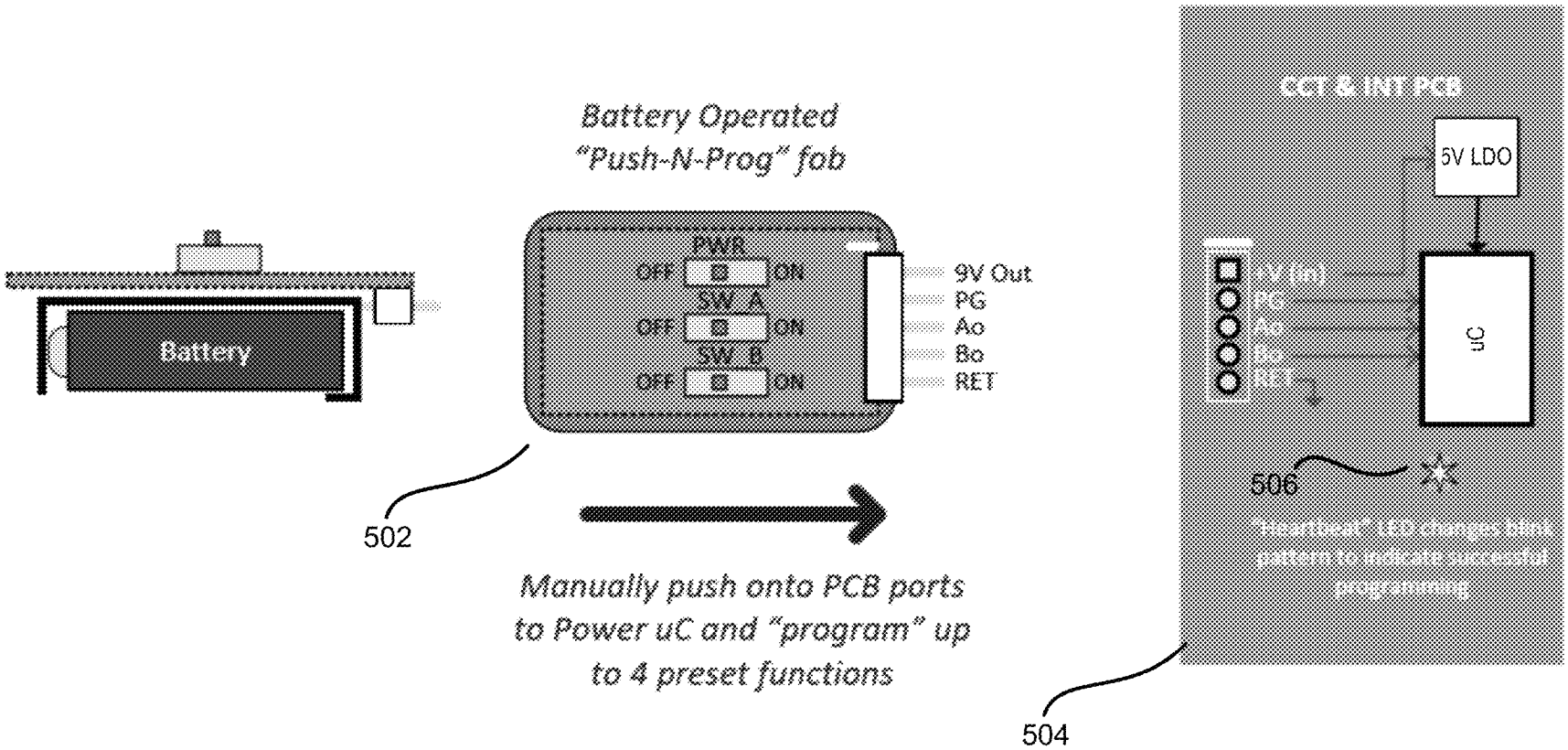
FIG. 5 depicts an example of a "Push-N-Program" interface device that can be connected to and program a controller to specify various settings for the light fixture, according to the present disclosure.

As discussed above, in order for the controller to control the color temperature, intensity and other properties of the light fixture, the controller can be programmed with settings for these varies properties of the light fixture through various interfaces. FIG. 5 illustrates a "Push-N-Program" interface device 502 that can be connected to a controller 504 and program the controller 504 to specify various settings for the light fixture, such as the color temperature and the intensity. The controller 504 can be a controller described above with regard to FIGS. 1-4C, or any combination thereof.

The middle figure of FIG. 5 shows a top view of the interface device 502 which includes multiple buttons for controlling the controller 504. For example, the PWR button can be configured to control the ON/OFF state of the interface device 502, the SW A button and the SW B button can each be set to an "ON" or "OFF" state, resulting in four combinations of the outputs of the interface device 502 (i.e. SW A ON and SW B ON, SW A ON and SW B OFF, SW A OFF and SW B ON, SW A OFF and SW B OFF). These four combinations can be used to program the controller 504 to up to four preset functions. For example, these four combinations can program the controller 504 to have four different color temperature and intensity settings. A specific state of the SW A button and the SW B button can thus set the controller to one of the four settings to control the light fixture accordingly.

The left figure of FIG. 5 illustrates a cross sectional view of the interface device 502 which shows that the interface device 502 is powered by a battery in this example. The battery can any type of battery, such as a 9V battery, a 12V battery and so on. The interface device 502 can also be powered by other forms of external power supplies. Since the interface device 502 is powered by an external power source, it can be configured to provide power to the controller 504 so that the controller 504 does not need to obtain power from the light fixture during programming. As shown in FIG. 5, the interface device 502 can be pushed into the PCB of the controller 504. In one example, an LED 506 on the PCB can be configured to change the blink pattern to indicate the successful programming of controller 504 using the interface device 502.

Figure 6:
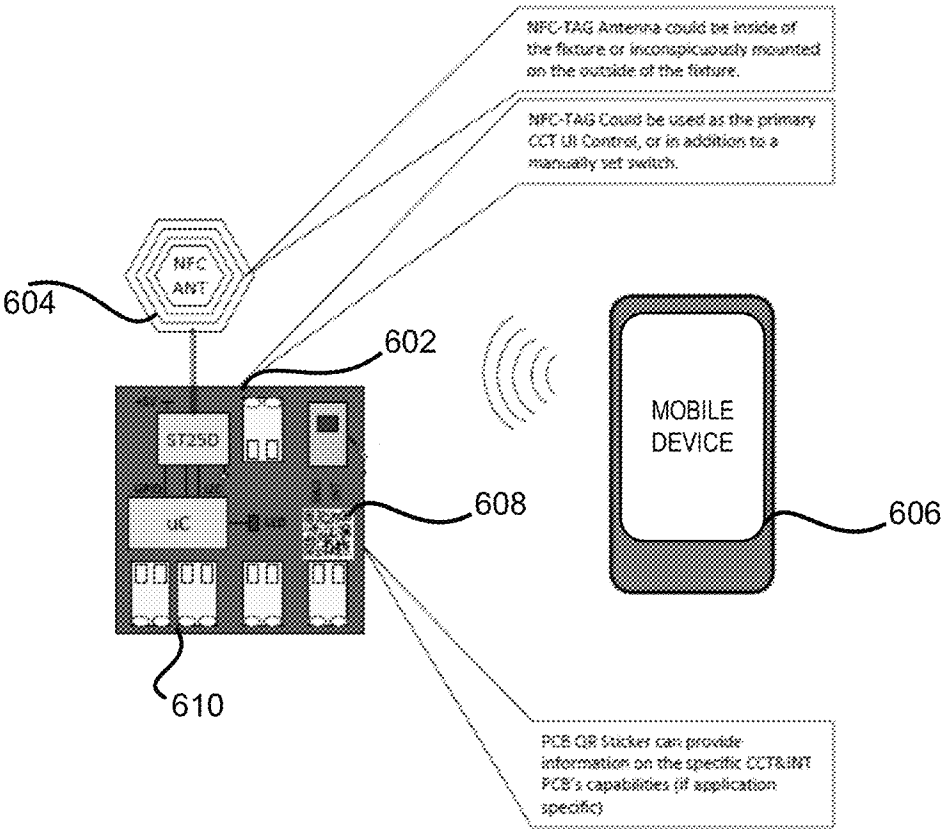
FIG. 6 depicts another example of an interface device that can be connected to and program the controller to specify various settings for the light fixture, according to the present disclosure.

FIG. 6 illustrates another example of an interface device that can be connected to and program the controller 610 to specify various settings for the light fixture. In the example shown in FIG. 6, a near field communication (NFC)-TAG interface 602 is utilized to program the controller 610. In order to enable the NFC, an NFC-TAG antenna 604 can be installed inside the light fixture or mounted on the outside of the light fixture. A mobile device 606 such as a smartphone can communicate with the controller through the NFC-TAG to program the controller. A PCB QR sticker 608 can be affixed to the printed circuit board (PCB) of the controller 610 so that the mobile device 606 can scan it to obtain information about the specific capabilities of the controller 610 and the light fixture, such as the supported color temperature and intensity settings or other parameters. Other components can be added to the PCB of the controller 610 to facilitate the programming of the controller.

In one example, the controller can be programmed with the proper firmware and the NFC programmed settings can be set to a default value, such as 50% of intensity. When installing the light fixture, an installer can scan the QR code to obtain the information about the light fixture and the controller. The installer can further use a phone app to program the NFC TAG to set the light fixture at a specific color temperature or intensity level. By implementing the interface device in this way, no special tools are required to program the controller. Further, the information needed for configuring the controller is readily available by scanning the QR code. As a result, a single light fixture can be utilized to provide multiple light outputs which are traditionally provided by multiple light fixtures.

It should be understood that the example interfaces shown in FIGS. 5 and 6 are for illustration purposes and should not be construed as limiting. Various other types of interfaces can also be utilized to pre-set or program the controller. The interfaces that can be utilized include, but are not limited to, slide switches, PCB Jumpers, tactile push-button programming, potentiometer, break away PCB tabs, strip-away PCB traces, changeable daughter-card PCB, IR-communication, NFC-Tag programming, capacitive touch pad on PCB, push-on programmer, Bluetooth wireless, wired network, digital addressable lighting interface (DALI), etc. In addition to standalone interfaces, control systems can also be utilized. For example, the circuit of the light fixture or the controller can be changed to allow DALI inputs to program the controller.

It should be further understood that the controller presented herein can be adapted with additional functionality such as wireless controls, expanded light engine configurations, communications interfaces, integrated sensors, alternate means of interfacing with the controller (human interface devices), etc.

General Considerations

The color temperatures, intensities, number of LED groups, number and arrangements of LEDs in an LED group, and currents used in the above examples are exemplary. Other implementations may use different values, numbers, or arrangements and may use other types of lighting elements. The fixture may be any type of a fixture, including a linear fixture, a downlight, or a flush mount fixture. The LEDs of the different LED groups may be arranged so that the LEDs from different groups are spatially interspersed in the fixture or may be arranged so that LEDs from different groups are separated in the fixture. Other light characteristics other than color temperature and intensity may also be changed or controlled.

A switch may use any type of component or combination of components to provide the described states or switching functions. A switch may include any type of mechanical, electrical, or software switch and a switch may be controlled or set directly or indirectly. A switch may be controlled by a user or by another component that is either part of the fixture or remote from the fixture.

Although the foregoing describes exemplary implementations, other implementations are possible. It will be appreciated that those skilled in the art, upon attaining an understanding of the foregoing, may readily produce alterations to, variations of, and equivalents to the described aspects. Accordingly, it should be understood that the present disclosure has been presented for purposes of example rather than limitation and does not preclude inclusion of such modifications, variations, and/or additions to the present subject matter as would be readily apparent to one of ordinary skill in the art.

Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The use of "adapted to" or "configured to" herein is meant as an open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

What is claimed is:

1. A light fixture comprising:

a first lighting element group and a second lighting element group, the first lighting element group comprising a first plurality of lighting elements and configured to produce light at a first color temperature, the second lighting element group comprising a second plurality of lighting elements and configured to produce light at a second color temperature; and a light fixture controller configured for performing operations for controlling color temperature and intensity of the light fixture, the operations comprising:

receiving a color temperature setting and an intensity setting for the light fixture;

generating control signals based, at least in part, upon the color temperature setting and the intensity setting for the light fixture, wherein the control signals comprise a first control signal and a second control signal, the first control signal configured for controlling an on/off state of the first lighting element group by controlling an open/closed state of a first switch connected to the first lighting element group, the second control signal configured for controlling an on/off state of the second lighting element group by controlling an open/closed state of a second switch connected to the second lighting element group, wherein the first control signal only turns on one or more lighting elements of the first lighting element group for a first duration of an ON/OFF cycle and the second control signal only turns on one or more lighting elements of the second lighting element group for a second duration of the ON/OFF cycle, wherein the ON/OFF cycle comprises multiple time periods, and during each of the multiple time periods, at least one lighting element group of the light fixture is set to be on and at least one another lighting element group of the light fixture is set to be off, a ratio between the first duration and the second duration is determined based, at least in part, upon the color temperature setting for the light fixture, the first switch connected to the first lighting element group and the second switch connected to the second lighting element group are further configured to control an intensity of the light fixture at a first intensity, the first lighting element group is further connected to a third switch and the second lighting element group is further connected to a fourth switch, the third switch and the fourth switch are configured to control the intensity of the light fixture at a second intensity, and the control signals further comprise a third control signal and a fourth control signal for controlling the third switch and the fourth switch, respectively.

2. The light fixture of claim 1, wherein the first control signal or the second control signal comprises a pulse width modulation (PWM) signal.

3. A light fixture controller configured for controlling a light fixture, the light fixture controller comprising:

one or more interfaces configured for receiving at least a color temperature setting and an intensity setting for the light fixture, wherein the light fixture comprises a first lighting element group and a second lighting element group, the first lighting element group comprising a first plurality of lighting elements and configured to produce light at a first color temperature, the second lighting element group comprising a second plurality of lighting elements and configured to produce light at a second color temperature; and a microcontroller configured for generating control signals based, at least in part, upon the color temperature setting and the intensity setting for the light fixture, wherein the control signals comprise a first control signal and a second control signal, the first control signal configured for controlling an on/off state of the first lighting element group by controlling an open/closed state of a first switch connected to the first lighting element group, the second control signal configured for controlling an on/off state of the second lighting element group by controlling an open/closed state of a second switch connected to the second lighting element group, wherein the first control signal only turns on one or more lighting elements of the first lighting element group for a first duration of an ON/OFF cycle and the second control signal only turns on one or more lighting elements of the second lighting element group for a second duration of the ON/OFF cycle, wherein the ON/OFF cycle comprises multiple time periods, and during each of the multiple time periods, at least one lighting element group of the light fixture is set to be on and at least one another lighting element group of the light fixture is set to be off, a ratio between the first duration and the second duration is determined based, at least in part, upon the color temperature setting for the light fixture, the first switch connected to the first lighting element group and the second switch connected to the second lighting element group are further configured to control an intensity of the light fixture at a first intensity, the first lighting element group is further connected to a third switch and the second lighting element group is further connected to a fourth switch, the third switch and the fourth switch are configured to control the intensity of the light fixture at a second intensity, and the control signals generated by the microcontroller further comprise a third control signal and a fourth control signal for controlling the third switch and the fourth switch, respectively.

4. The light fixture of claim 1, further comprising a driver for powering the first lighting element group and the second lighting element group, wherein the control signals further comprise a dimming control signal configured for controlling the driver of the light fixture to adjust a current flowing through both the first lighting element group and the second lighting element group based on the intensity setting for the light fixture.

5. The light fixture of claim 4, wherein the dimming control signal comprises a 0-10V control signal having a value varying between 0 and 10V.

6. The light fixture of claim 4, wherein the driver of the light fixture is a single-channel driver.

7. The light fixture of claim 1, wherein the first switch is connected in series with x % of the first plurality of lighting elements in the first lighting element group and in parallel with remaining 1-x % of the first plurality of lighting elements in the first lighting element group;

the third switch is connected in series with y % of the first plurality of lighting elements in the first lighting element group and in parallel with remaining 1-y % of the first plurality of lighting elements in the first lighting element group; and the first intensity is smaller than the second intensity and $x<y$, wherein each of x and y is a non-negative number and $0 \leq x,y \leq 100$.

8. The light fixture of claim 7, wherein:

the second switch is connected in series with x % of the second plurality of lighting elements in the second lighting element group and in parallel with remaining 1-x % of the second plurality of lighting elements in the second lighting element group; and the fourth switch is connected in series with y % of the second plurality of lighting elements in the second lighting element group and in parallel with remaining 1-y % of the second plurality of lighting elements in the second lighting element group.

9. The light fixture of claim 1, wherein a lighting element is a light-emitting diode (LED) or an organic light-emitting diode (OLED).

10. A method for controlling color temperature and intensity of a light fixture, comprising:

receiving, at a light fixture controller of the light fixture, a color temperature setting and an intensity setting for the light fixture, the light fixture comprising a first lighting element group and a second lighting element group, the first lighting element group comprising a first plurality of lighting elements and configured to produce light at a first color temperature, the second lighting element group comprising a second plurality of lighting elements and configured to produce light at a second color temperature;

determining, by the light fixture controller, an ON/OFF cycle for the first lighting element group and the second lighting element group based on the color temperature setting, wherein the ON/OFF cycle comprises multiple time periods, and during each of the multiple time periods, at least one lighting element group is turned ON and at least one another lighting element group is kept OFF, and wherein a ratio between the multiple time periods is determined based, at least in part, upon the color temperature setting for the light fixture; and generating, by the light fixture controller, control signals based, at least in part, upon the color temperature setting and the intensity setting for the light fixture, wherein the control signals comprise a first control signal and a second control signal, the first control signal configured for controlling an on/off state of the first lighting element group by controlling an open/closed state of a first switch connected to the first lighting element group, the second control signal configured for controlling an on/off state of the second lighting element group by controlling an open/closed state of a second switch connected to the second lighting element group, wherein:

the first control signal only turns on one or more lighting elements of the first lighting element group for a first duration of an ON/OFF cycle and the second control signal only turns on one or more lighting elements of the second lighting element group for a second duration of the ON/OFF cycle, the first switch connected to the first lighting element group and the second switch connected to the second lighting element group are further configured to control an intensity of the light fixture at a first intensity, the first lighting element group is further connected to a third switch and the second lighting element group is further connected to a fourth switch, the third switch and the fourth switch are configured to control the intensity of the light fixture at a second intensity, and the control signals further comprise a third control signal and a fourth control signal for controlling the third switch and the fourth switch, respectively.

11. The method of claim 10, wherein a lighting element is a light-emitting diode (LED) or an organic light-emitting diode (OLED).

12. The method of claim 10, wherein each of the control signals comprises a pulse width modulation (PWM) signal.

13. The light fixture controller of claim 3, wherein the one or more interfaces comprise at least one of, switches, tactile buttons, break-away PCB tabs or traces, near field communication (NFC)-TAG interfaces, digital wired network communication interfaces, wireless communication interfaces, or optical communication interfaces.

14. The light fixture controller of claim 3, wherein the light fixture further comprises a driver for powering the first lighting element group and the second lighting element group, and wherein the control signals further comprise a dimming control signal configured for controlling the driver of the light fixture to adjust a current flowing through both the first lighting element group and the second lighting element group based on the intensity setting for the light fixture.

15. The light fixture controller of claim 14, wherein the driver of the light fixture is a single-channel driver.

16. The light fixture controller of claim 3, wherein the first control signal or the second control signal comprises a pulse width modulation (PWM) signal.

17. The light fixture controller of claim 3, wherein a lighting element is a light-emitting diode (LED) or an organic light-emitting diode (OLED).

18. The light fixture controller of claim 3, wherein:

the first switch is connected in series with x % of the first plurality of lighting elements in the first lighting element group and in parallel with remaining 1-x % of the first plurality of lighting elements in the first lighting element group;

the third switch is connected in series with y % of the first plurality of lighting elements in the first lighting element group and in parallel with remaining 1-y % of the first plurality of lighting elements in the first lighting element group; and the first intensity is smaller than the second intensity and $x<y$, wherein each of x and y is a non-negative number and $0 \leq x,y \leq 100$.

19. The light fixture controller of claim 18, wherein:

the second switch is connected in series with x % of the second plurality of lighting elements in the second lighting element group and in parallel with remaining 1-x % of the second plurality of lighting elements in the second lighting element group; and the fourth switch is connected in series with y % of the second plurality of lighting elements in the second lighting element group and in parallel with remaining 1-y % of the second plurality of lighting elements in the second lighting element group.

20. The light fixture controller of claim 3, wherein the microcontroller is further configured for generating control signals for controlling a light distribution of the light fixture.

* * * * *